US005997206A

United States Patent [19]

Lin

[11] Patent Number: 5,997,206

[45] Date of Patent: Dec. 7, 1999

[54] REFILLABLE LIPSTICK

[76] Inventor: Jen-Meng Lin, P.O. Box 90, Tainan City, Taiwan

[21] Appl. No.: 09/235,309

[22] Filed: Jan. 22, 1999

[51] Int. Cl.[6] ..... A46B 11/02

[52] U.S. Cl. ..... 401/150; 401/151; 401/188 R

[58] Field of Search ..... 401/150, 151, 401/187, 188 R

[56] References Cited

U.S. PATENT DOCUMENTS

| | | | |
|---|---|---|---|
| 2,693,172 | 11/1954 | Miessner | 401/151 |
| 2,896,238 | 7/1959 | Riel | 401/150 |
| 3,351,074 | 11/1967 | Aston | 401/150 |
| 3,756,729 | 9/1973 | Tufts | 401/150 |
| 4,930,923 | 6/1990 | Reichmann | 401/151 |
| 5,518,331 | 5/1996 | Moosmann et al. | 401/151 |

*Primary Examiner*—Charles R. Eloshway

[57] ABSTRACT

A refillable lipstick includes a long cylinder, a guide rod extending in the cylinder to be pushed by a cone-shaped push button with an upper end of the guide rod and fitted in a cone-shaped hole of a stopper fixed in the upper end of the cylinder to let air enter and compressed to squeeze colloid lipstick to spread on a brush fixed under a cylindrical head threadably connected with a lower end of the cylinder. A guide brush fixed under a lower end of the guide rod is fitted in the brush to let colloid lipstick spread on the brush. The push button can be repeatedly pressed and pushed backby a compressing spring fitted between the push button and a position disc. The cylindrical head can be screwed off for refilling lipstick in case of lipstick stored in the cylinder used up.

4 Claims, 2 Drawing Sheets

REFILLABLE LIPSTICK

BACKGROUND OF THE INVENTION

This invention relates to a refillable lipstick, particularly to one utilizing a push button to force air into a long cylinder so as to push colloid lipstick to a brush fixed at a cylinder head, with colloid lipstick being painted with the brush on a lip of a user. Then colloid lipstick may be refilled in the cylinder for using the cylinder again and again, saving expense.

A known conventional lipstick shown in FIG. 1, includes a rotatable outer cylinder 10, a threaded rod 100 fixed in the outer cylinder 10, an inner cylinder 11 provided in the outer cylinder 10, and a lipstick movably fitted in the inner cylinder 11.

The inner cylinder 10 has an exit 110 formed in a front end, and a threaded sleeve 111 is fitted around a rear end of the inner cylinder 11 and threadbly connected with the threaded rod 100 in the outer cylinder 10. Further, a push disc 101 is provided to be located just behind a rear end of the lipstick 12, urged by a front end of the threaded rod 100. A tubular cap 13 closes a front end of the inner cylinder 11, having an inner annular wall 130 formed in a rear portion, and a cone-shaped inner wall 131 formed in front of the inner annular wall 130.

In using, the outer cylinder 10 is rotated clockwise, permitting the inner cylinder 11 to move in the outer cylinder 10 by means of the threaded rod 100 engaging with the threaded sleeve 111. Meanwhile, the threaded rod 100 pushes the push disc 101, forcing the lipstick to extend out of the exit 110 for use.

If the lower end of the lipstick 12 is needed to be shaped pointed owing to it flattening or becoming broken, the outer cylinder 10 is rotated to force the inner cylinder 11 move in the outer cylinder 10, with the threaded rod 100 pushing down the push disc 101, which then pushes the lipstick 12 to protrude gradually out of the exit 110, with the lower end of the lipstick 12 moving in the cone-shaped wall 131 and be squeezed and formed into the cone shape of the wall 131, convenient to be painted on a lip.

The conventional lipstick utilizes rotation of the threaded rod 100 to push the lower end of the lipstick 12 into the cone-shaped wall 131 to be shaped as a cone for use. However, chances are that the lipstick 12 may be either squeezed excessively to flow out of the exit 110 or squeezed not enough to shape it into a cone for use. Thus, flowing volume is not easy to control and the lipstick is liable to harden and stick on the cone-shaped wall 131 and not easy release. Besides, in cold winter weather the lipstick easily condenses into solid, and is difficult to be squeezed forward.

SUMMARY OF THE INVENTION

The object of the invention is to offer a refillable lipstick possible to be refilled with colloid lipstick in a cylinder again and again in case the lipstick is used up.

The feature of the invention is a long cylinder, a position disc, a compression spring, and a stopper fixed in an upper end of the cylinder, a guide rod extending in the cylinder and protruding out of the position disc and the compression spring, a cone-shaped push button fitted in a cone-shaped hole of the stopper and fixed with the upper end of the guide rod and protruding out of the upper end of the cylinder. The lower end of the guide rod is provided with a guide brush, and the lower end of the cylinder is threadably connected with a cylindrical head, with an annular anti-leak ring located between the cylinder and the cylindrical head. Further, a brush is fixed under the lower end of the cylindrical head and has a material hole for colloid lipstick to flow through. Then the guide brush of the guide rod is fitted in the material hole, and a cap closes on the lower end of the cylindrical head.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
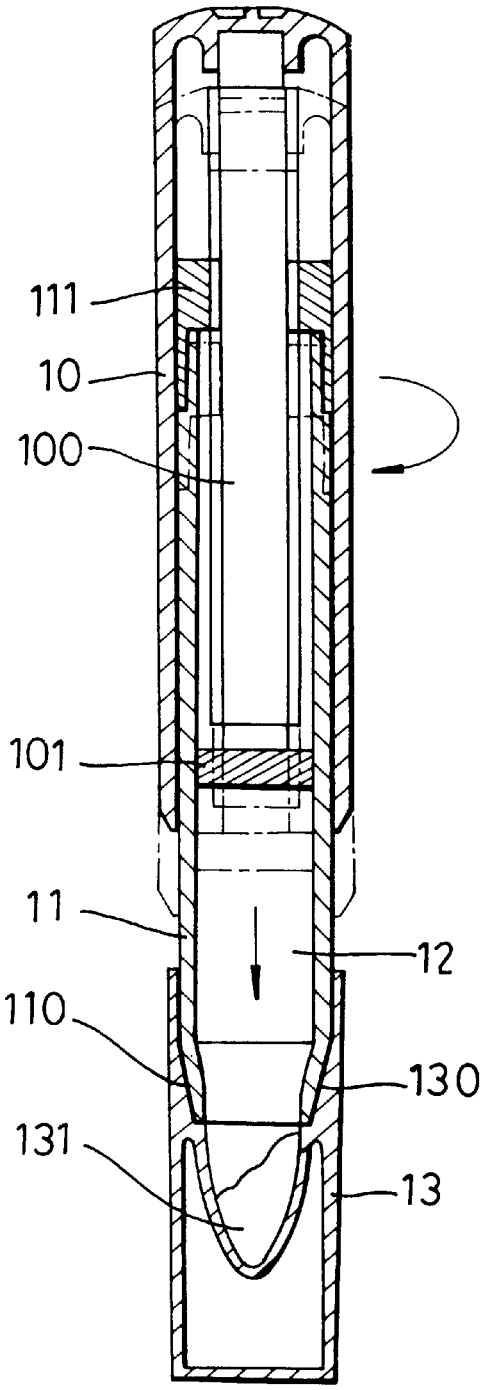
FIG. 1 (PRIOR ART)
FIG. 1 is a cross-sectional view of a known conventional lipstick.
Figure 2:
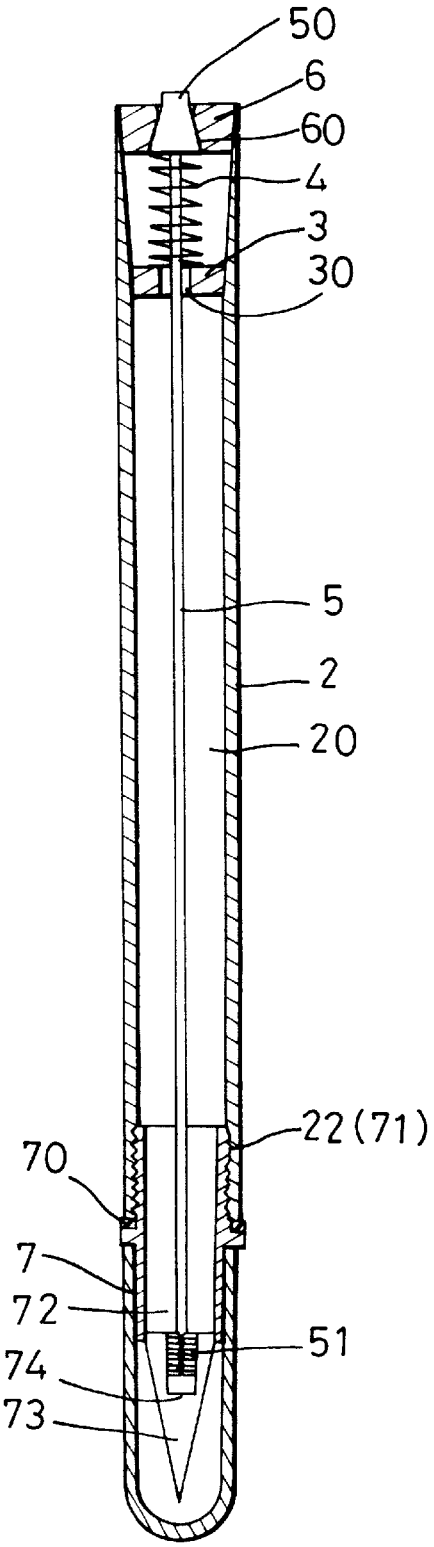
FIG. 2 is a cross-sectional view of a refillable lipstick in the present invention; and, FIG. 3 is a cross-sectional view of the refillable lipstick being used in the present invention.

A preferred embodiment of a refillable lipstick in the present invention, as shown in FIG. 2, includes a long cylinder 2, a position disc 3, a compression spring 4, a long guide rod 5, a stopper 6, a cylindrical head 7 as main components combined together.

The long cylinder 2 has a center lengthwise hollow 20, a cone-shaped inner wall 21 formed in an upper end portion, and female threads 22 formed in a lower end portion.

The position disc 3 is fixed firmly in a bottom of the cone-shaped wall 21 of the center hollow 20 of the cylinder 2, having a center hole 30 for the long guide rod 5 to pass through.

The compression spring 4 is located on the position disc 3 in the cone-shaped inner wall 21, with its upper end biasing on a lower end of a push button 50 so that the spring 4 pushes elastically back the push button 50 when the button 50 is pressed down.

The guide rod 5 extends through the compression spring 4, the center hole 30 of the position disc 3 and in the hollow 20 of the cylinder 2, having the cone-shaped push button 50 fixed on an upper end and a guide brush 51 fixed on a lower end.

The stopper 6 is fixed in an upper end of the center hollow 20 of the cylinder 2, having a cone-shaped hole 60 for the push button 50 to fit therein.

The cylindrical head 7 is threadably connected with a lower end of the cylinder 2 by means of male threads 71 formed in an upper end portion to engage the female threads 22 of the cylinder 2 with an annular leak ring 70 provided between the cylindrical head 7 and the cylinder 2, having a lengthwise center passageway 72 and a brush 73 fixed with a lower end and provided with a center material hole 74. Further, a lower end of the guide rod 5 extends in the passageway 72 of the cylindrical head 7. The guide brush 51 of the guide rod 5 is fitted in the center material hole 74 of the brush 73. Then a tubular cap is provided to close under the cylindrical head, surrounding the brush 73. Thus, the refillable lipstick is assembled together.

Figure 3:
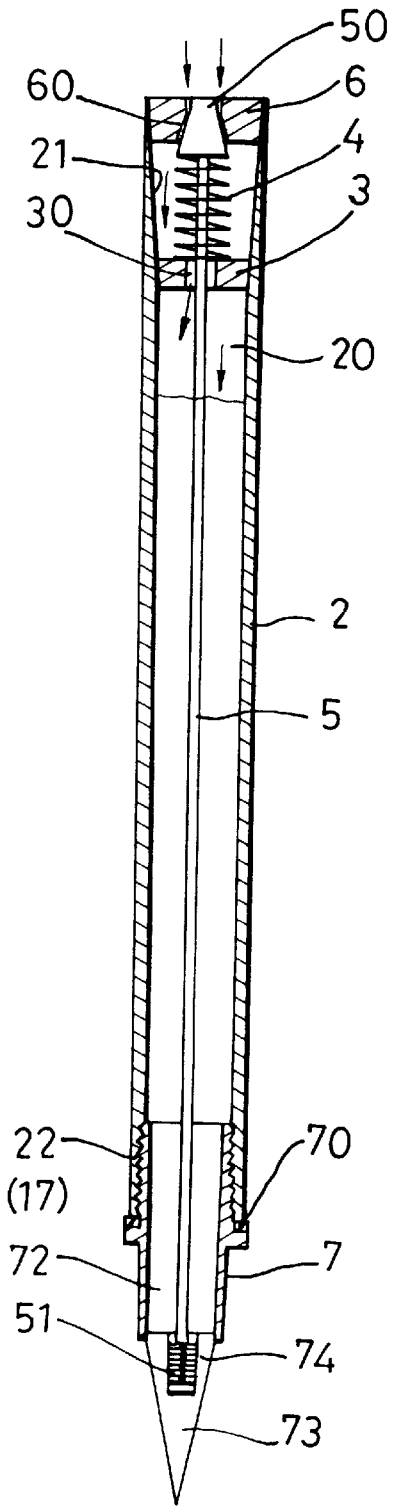

In using, referring to FIGS. 2 and 3, firstly colloid lipstick is filled in the hollow 20 of the cylinder 2 through the lower end mouth of the cylinder 2, with the cylindrical head 7 screwed off, and the push button 50 is pressed repeatedly to compress the compression spring 4 and the guide rod 5. Then air will flow and be compressed by up-and-down movement of the push button 50 through the cone-shaped hole 60 into the hollow 20, squeezing the colloid lipstick down through the passageway 72 of the cylindrical head 7 to the brush 73. So the brush 73 is spread with the colloid lipstick. After the brush 73 has proper volume of lipstick, lipstick is ready for use. Then the push button 50 is released from squeezing, and the push button 50 and the guide rod 5 are to be retreated back to its original position by the recovered elasticity of the compression spring 4. And the aforesaid operation is repeated in next use.

In order to permit colloid lipstick flow to the brush 73, the push button 50 and the guide rod 5 function to let air compressed to squeeze colloid lipstick flow smoothly. And the guide brush 51 also moves down to lead colloid lipstick to the brush 73 so as to operate surely spreading colloid lipstick on the brush 73.

In case that the lipstick in the hollow 20 is used up, the cylindrical head 7 may be screwed off the cylinder 2, and new colloid lipstick may be filled through the lower end mouth of the cylinder 2 into the hollow 20 by a user, and the cylindrical head 7 is threadably closed the cylinder 2 after refilling, for reuse based on environmental protecting idea.

The refillable lipstick in the invention has the following advantages, as can be understood from the aforesaid description.

1. The cylindrical head may be screwed off for refilling colloid lipstick for repeating use, meeting environmental protection idea.

2. In case of cold weather, colloid lipstick may be squeezed to flow to the brush by means of the guide rod and the guide brush without any difficulty.

3. The components are simply structured, convenient to assemble.

While the preferred embodiment of the invention has been described above, it will be recognized and understood that various modifications may be made therein and the appended claims are intended to cover all such modifications which may fall within the spirit and scope of the invention.

What is claimed is:

1. A refillable lipstick comprising:

a long cylinder having a center lengthwise hollow;

a position disc, a compression spring and a stopper fixed in an upper end of said center lengthwise hollow;

a guide rod extending in said center lengthwise hollow and protruding through said position disc and said compression spring;

a push button fixed with an upper end of said guide rod and protruding out of said stopper;

a guide brush fixed with a lower end of said guide rod;

a cylindrical head connected with a lower inner end portion of said cylinder;

an annular anti-leak ring provided between said cylinder and said cylindrical head;

a brush fixed under a lower end of said cylindrical head and having a center material hole;

said guide brush of said guide rod fitted in said material hole of said brush, and a tubular cap closing under said cylindrical head;

said push button pressed inward repeatedly to push said guide rod down and, at the same time, forming a gap between said push button and said stopper to let air flow into and be compressed in said center lengthwise hollow of said cylinder so as to squeeze colloid lipstick stored in said center lengthwise hollow so that it flows to and spreads on said brush for a user to paint on her lip, said guide rod and said guide brush assisting colloid lipstick to flow smoothly to said brush, the refillable lipstick being refillable with colloid lipstick repeatedly in case the colloid lipstick is used up.

2. The refillable lipstick as claimed in claim 1, wherein said center lengthwise hollow of said cylinder is provided with female threads formed in a lower end portion, and said cylindrical head is provided with male threads formed in an upper end portion so that said cylinder and said cylindrical head threadably engage with each other.

3. The refillable lipstick as claimed in claim 1, wherein said center lengthwise hollow of said cylinder is provided with a cone-shaped wall in an upper end portion.

4. The refillable lipstick as claimed in claim 1, wherein said stopper is provided with a center hole of a cone shape, and said push button fixed with the upper end of said guide rod is also shaped as a cone to fit in said cone-shaped center hole of said stopper.

* * * * *